US005517696A

United States Patent [19]

Krugler

[11] Patent Number: 5,517,696

[45] Date of Patent: May 21, 1996

[54] MULTIPLE COMPARTMENT GARMENT ACCESSORY POCKET

[76] Inventor: David E. Krugler, 13716 W. Rim #601, Euless, Tex. 76040

[21] Appl. No.: 183,652

[22] Filed: Jan. 19, 1994

Related U.S. Application Data

[63] Continuation-in-part of Ser. No. 874,593, Apr. 27, 1992, abandoned.

[51] Int. Cl.[6] ..... A41D 27/20; A45F 5/00

[52] U.S. Cl. ..... 2/250; 2/247; 2/919; 224/223; 224/901; 224/918; 224/245

[58] Field of Search ..... 224/191, 918, 224/919, 901, 223, 245, 230; 2/249, 250, 247, 94, 919

[56] References Cited

U.S. PATENT DOCUMENTS

| | | | |
|---|---|---|---|
| 530,542 | 12/1894 | Mahon | 2/250 |
| 581,655 | 4/1897 | Burger | 2/250 |
| 1,161,435 | 11/1915 | Baker . | |
| 1,212,639 | 1/1917 | Hester . | |
| 1,719,244 | 7/1929 | Shirk | 2/251 |
| 2,312,177 | 2/1943 | Lester . | |
| 3,320,620 | 5/1967 | Weidler et al. | 2/250 |
| 3,425,062 | 2/1969 | Chujfi | 2/247 |
| 3,918,718 | 11/1975 | Billow | 224/918 |
| 3,968,522 | 7/1976 | Riess . | |
| 5,072,456 | 12/1991 | Elin . | |

*Primary Examiner*—Linda J. Sholl
*Attorney, Agent, or Firm*—Charles D. Gunter, Jr.

[57] ABSTRACT

An accessory pocket is shown for an item of golfing wearing apparel, such as golfing shorts or pants. The accessory pocket includes a panel which is made of a material adapted to conform to the wearer's body, the panel being affixed in permanent fashion to the item of wearing apparel to define a pocket for receiving a golfing score card. A fabric strip runs across the panel outer wall between opposing side edges and is attached to the panel at intervals to form tee loop openings for receiving golfing tees. The fabric strip used to form the loop openings includes at least a partial rubber backing to facilitate the frictional engagement of golfing accessory items within the loop openings. Fabric can also be utilized to form pockets for receiving a golf scoring pencil and a green repair tool. A ball mark retainer located on the panel outer wall engages a disc-like ball marker in snap-on fashion.

6 Claims, 3 Drawing Sheets

MULTIPLE COMPARTMENT GARMENT ACCESSORY POCKET

CROSS REFERENCE TO RELATED APPLICATIONS

This application is a continuation-in-part of my earlier filed application, Ser. No. 07/874,593, filed Apr. 27, 1992, and entitled "Golf Score Card And Accessory Pocket", now abandoned.

BACKGROUND OF THE INVENTION

1. Field of the Invention

The present invention relates generally to an accessory pocket for an item of wearing apparel and, specifically, to a permanently sewn accessory pocket for an item of golfing wearing apparel, the pocket being particularly adapted to hold a golf score card and other related golfing accessories.

2. Description of the Prior Art

Various accessory pocket designs are shown in the prior art which are useful for a variety of purposes, the pocket configuration being designed around the particular area of interest. For instance, Lester U.S. Pat. No. 2,312,177 shows a multiple pocket for garments for use on bib overalls of the type which might be worn by a carpenter or tradesman. U.S. Pat. No. 1,161,435 shows a pocket for a jacket, trousers, or apron of an overalls which includes sub-pockets for holding the usual tools of a machinist, engineer, carpenter or other artisan. Elin U.S. Pat. No. 5,072,456 shows a more modern outerwear garment for emergency medical personnel which includes an accessory pocket for tools and equipment which allows the items in the pocket to always be within the direct view of the wearer and within easy reach.

In the area of golfing, various accessory holding devices are known. Such devices have generally been provided in the form of an accessory pouch worn on the belt of the user or in the form of an accessory case which could be mounted on the golf bag or golf cart. Devices mounted on the golf bag or cart do not provide immediate access to the accessories needed by the golfer such as the golfing tee, score card, score card pencil, ball marker or green repair tool. Accessory pouches worn about the waist or belt of the user provide more immediate access to the previously mentioned accessories but can restrict the freedom of movement of the user and be uncomfortable to wear.

Riess U.S. Pat. No. 3,968,522, issued Jul. 13, 1976, and Weidler et al. U.S. Pat. No. 3,320,620, issued May 23, 1967, both show auxiliary pockets for golfer's slacks. Both designs are bulky and incorporate golf ball receiving structures. Reiss includes a golf ball receiving "tube" but lacks a score card pocket. The pocket can be attached in various locations and removed for cleaning. The Weidler pocket is concealed within a garment pocket and flaps out of the garment pocket to hold golf balls and tees.

A need exists for a low profile accessory pocket for an item of golfing wearing apparel which is permanently affixed to the garment and which closely conforms to the golfer's body during use in order to allow complete freedom of movement and the greatest degree of comfort.

A need also exists for such an accessory pocket which provides convenient access to those articles commonly used during the game of golf providing immediate access to such items without requiring the user to return to the golf cart or golf bag.

Another object of the invention is to provide a golf score card and accessory pocket, permanently affixed to an item of golfing wearing apparel which is complimentary in fabric and color to the item of wearing apparel to present a pleasing aesthetic appearance while offering the utility of immediate access to the aforementioned golfing accessories.

Another object of the invention is to provide an accessory pocket having multiple accessory receiving loop openings of an improved construction for frictionally engaging accessories, such as golfing tees, within the loop openings.

Another object of the invention is to provide an accessory pocket for pleasing aesthetic appearance having such loop openings of an inexpensive and improved construction which eliminates production problems associated with fabric shading and which functionally allows accommodation of a wider range of sizes of accessories which can be carried simultaneously or separately within the loop openings.

SUMMARY OF THE INVENTION

The accessory pocket for an item of golfing wearing apparel of the invention includes a panel made from a material adapted to conform to a wearer's body. The panel has a planar inner wall, a planar outer wall, a top edge, a bottom edge and opposing side edges. At least selected edges of the panel are adapted to be permanently affixed to the item of wearing apparel in a selected location to define a pocket having a pocket opening sized to receive a golfing score card. An engaging strip, such as a fabric strip, runs across the outer planar wall between the opposing side edges. The fabric strip is attached to the panel at selected intervals to form a series of tee loop openings for receiving golfing tees. In similar fashion, a fabric pencil loop opening can also be provided to receive a golf scoring pencil. Preferably, the bottom edge and opposing side edges of the panel are affixed to the item of wearing apparel to define a top pocket opening for the accessory pocket for receiving a golfing score card. The panel top edge can be cut at an angle with respect to the panel bottom edge to leave at least a portion of the golfing score card visible when inserted into the accessory pocket. A fabric green repair tool opening can also be provided for receiving a green repair tool. The panel used to form the accessory pocket can conveniently be formed of a cloth material which is complimentary to the fabric and color of the item of wearing apparel. The panel is permanently affixed to the item of wearing apparel at the time of manufacture or in a post-manufacturing operation.

The preferred accessory pocket includes a low profile panel made of a soft material, such as cotton, which is easily adapted to conform to the wearer's body. The fabric strip runs generally horizontally across the outer planar wall between the opposing side edges of the panel. The fabric strip is attached to the panel at selected intervals to form a series of vertical tee loop openings for receiving golfing tees. Each tee loop opening includes a top opening and a bottom opening for exposing a top and bottom portion, respectively, of a golfing tee. The fabric is of a predetermined width, whereby a golfing tee will protrude from both the top and bottom openings to facilitate extraction of the tee from the tee loop opening during use. Preferably, the fabric strip used to form the tee loop openings includes at least a partial rubber backing to facilitate the frictional engagement of the golfing tees within the loop openings. In some embodiments of the accessory pocket of the invention, a mating hook and loop fabric surface is provided on a portion of the panel outer wall for engaging a mating hook and loop fabric of a golfing glove to temporarily secure the golfing glove to the accessory pocket. At least one ball marker retainer is preferably located on the panel planar outer wall, the retainer including a snap fastener recess for retaining a ball marker of the type comprising a disc-like portion having a projecting stud with a headed portion adapted to be received within the snap fastener recess.

The accessory pocket is most preferably permanently affixed to a pair of golfing slacks or shorts or to a shirt or jacket.

Additional objects, features and advantages will be apparent in the written description which follows.

DETAILED DESCRIPTION OF THE INVENTION

Figure 1:
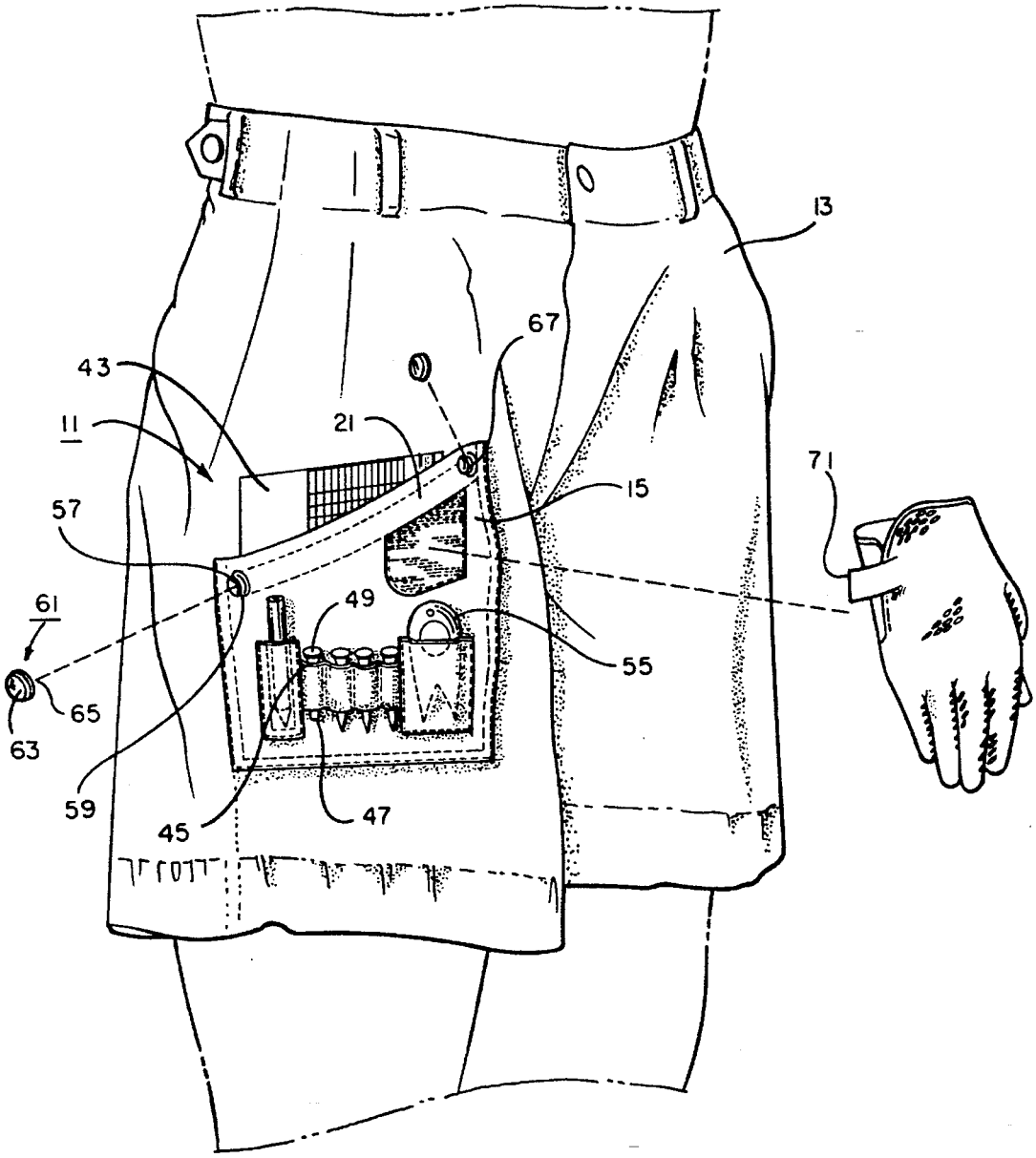
FIG. 1 is a perspective view of an accessory pocket of the invention permanently affixed to an item of golfing wearing apparel, certain of the golfing accessories normally associated with the pocket being shown in exploded fashion.

FIG. 1 shows a low profile accessory pocket of the invention designated generally as 11. The accessory pocket is shown permanently affixed to an item of golfing wearing apparel, in this case golfing shorts 13. While the invention is shown in terms of the golfing shorts 13, it will be understood that the accessory pocket could be permanently affixed to golfing slacks, pants, and to a golfing shirt or jacket, as well.

Figure 2:
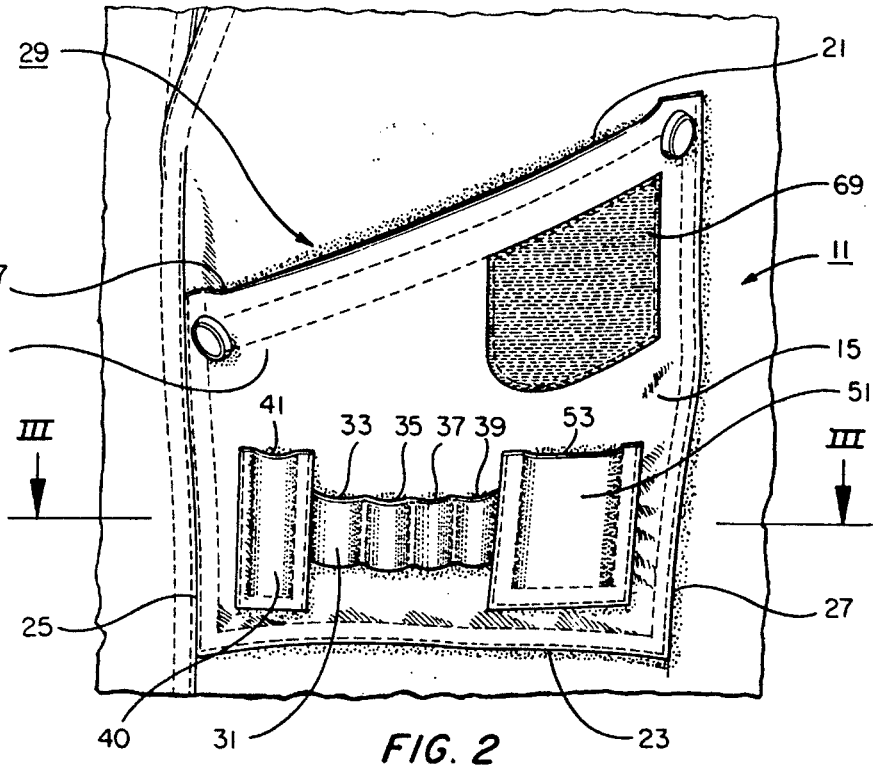
FIG. 2 is an isolated view of the accessory pocket of FIG. 1 without the various accessories being installed.
Figure 3:
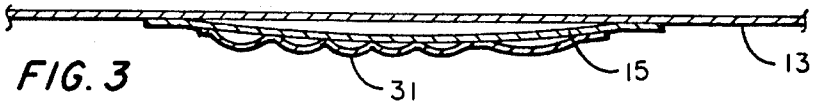
FIG. 3 is a cross-sectional view taken along lines III—III in FIG. 2.

Turning to FIG. 2, the accessory pocket 11 of the invention includes a panel 15 made of a material adapted to conform to a wearer's body. In the example shown, the material is preferably denim, cotton, synthetic, or other cotton-synthetic cloth blends. The panel has a planar inner wall 17, a planar outer wall 19, a top edge 21, a bottom edge 23 and opposing side edges 25, 27. At least selected edges of the panel 15 are adapted to be affixed to the item of wearing apparel 13 to define a pocket having a pocket opening (generally at 29 in FIG. 2) sized to receive a golfing score card.

As shown in FIG. 2, the bottom edge 23 and opposing side edges 25, 27 are preferably affixed, as by stitching, to the item of wearing apparel to define a top pocket opening 29 for receiving a golfing score card. The panel top edge 21 is preferably cut at an angle with respect to the panel bottom edge 23 to leave at least a portion (43 in FIG. 1) of the golf score card visible when inserted into the accessory pocket.

An engaging strip, such as fabric strip 31, runs across the outer planar wall 19 between the opposing side edges 25, 27. As shown in FIG. 2, the fabric strip 31 is attached to the panel at selected intervals to form a series of tee loop openings 33, 35, 37, 39 for receiving golfing tees.

The panel 15 can conveniently be formed of a cloth material which is complimentary to the fabric and color of the item of wearing apparel 13. The panel 15 can be permanently affixed to the item of wearing apparel at the time of manufacture of the item or can be permanently affixed in a post-manufacturing operation.

The fabric strip 31 can be formed of a stretch fabric in order to more securely retain a golfing accessory, such as a golf tee, within the loop openings thereof. However, the use of a stretch fabric presents certain problems in manufacture, particularly color shading problems in long production runs. It is not economically possible to satisfactorily match the color of a stretch fabric to the remaining panel color over a long production run.

Figure 6:
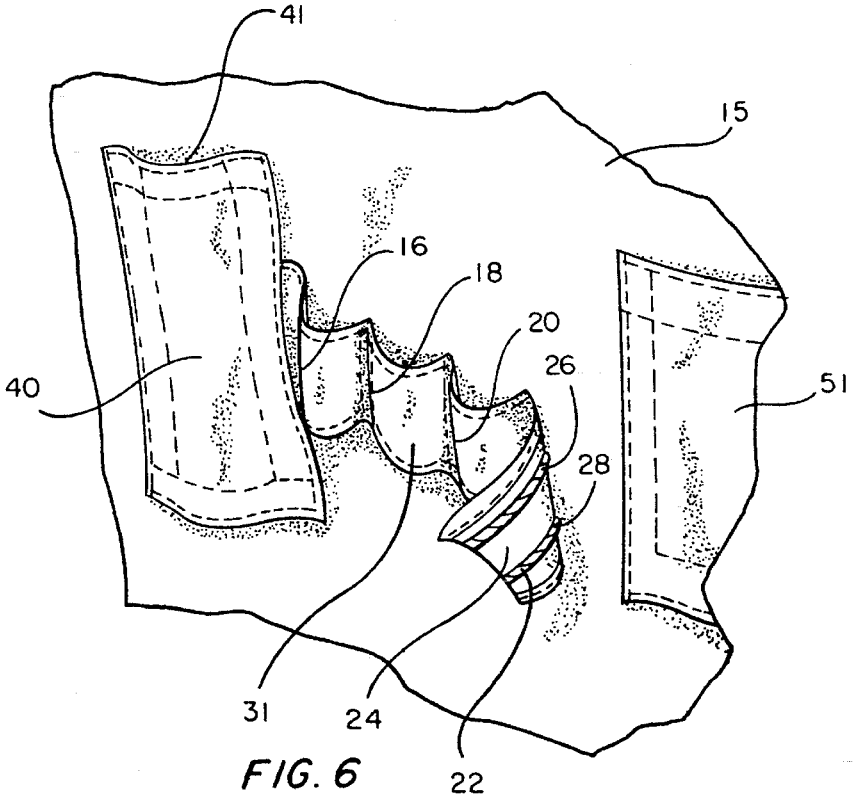
FIG. 6 is a close-up view of the fabric strip which forms the tee loop openings of the accessory pocket with the fabric strip being partially pulled back to show the rubber backing thereof.

FIG. 6 shows the preferred non-stretch fabric strip 31 which is cut from the same fabric as the remainder of the panel 15, in this case denim. The fabric strip has vertical seams 16, 18, 20 sewn therein to define the tee loop openings 33, 35, 37, 39 (see FIG. 2). In this embodiment of the invention, however, the denim fabric strip 31 includes at least a partial rubber backing 22 to facilitate the frictional engagement of the golfing tees within the loop openings.

In the embodiment of FIG. 6, a separate backing strip 24 is sewn behind the outer denim strip 31 and contains spaced apart, horizontal rows 26, 28 of rubber-like material to provide enhanced frictional engagement of even a variety of sized tees received within the loop openings. The rubber-like material is preferably a natural or synthetic elastomeric material similar to a rubber band. Although the rubber-like material can be incorporated within the stitching of the backing strip 24, it could be attached by other means, such as by cementing the rubber strip in a horizontal row on the backing strip 24. The rubber-like material could also cover a larger area, or even the entire inner surface of the backing strip 24, although discrete rows of the rubber-like material are preferred.

As will be apparent from FIGS. 1 and 2, the pocket opening 29 is constructed of a sufficient size to enclose and cover the major portion of a standard size golf score card when the score card is fully inserted into the pocket. In the preferred embodiment of FIG. 1, only the top left, as viewed from the front, of the enclosed score card is visible and protruding from the accessory pocket. This feature allows easy extraction of the enclosed score card, and at the same time minimizes inadvertent contact of the score card with objects passing in close proximity to the pocket. The generally low profile nature of the accessory pocket 11 serves to reduce and minimize any possible interference between the enclosed card and any body movement which might normally be performed by the golfer in the performance of a typical golfing activity. The design and function of the accessory pocket 11 serve to protect and preserve the integrity of the enclosed score card throughout the performance of golfing activities by reducing inadvertent contact.

The accessory pocket panel also preferably includes a pencil pocket 40 having a pocket opening 41 for receiving a golf scoring pencil. The pencil pocket 40 is preferably constructed of sufficient size to accommodate a standard size wooden golf pencil which typically measures about 3½" in length and which is utilized at most golf courses for recording golf notations. The pencil pocket 40 is constructed from the same material as the panel 15 as is of the approximate diameter of a typical golf pencil so that insertion of the pencil into the pocket will slightly expand the pocket, thereby exerting a frictional engagement pressure against the enclosed pencil and secure the pencil within the pocket to further enhance retention of the pencil during the performance of golfing activities. The pencil pocket 40 can also be provided with a rubber backing, similar to that of the fabric strip 31.

The fabric strip that forms the tee loop openings 33, 35, 37, 39 is constructed in such manner as to provide a horizontal row of vertical golf tee-holder pockets or sleeves which will enhance selection of a tee as required throughout the performance of golf activities. As shown in FIG. 1, the tee loop openings include both top and bottom openings 45, 47 for exposing a top and bottom portion, respectively, of a golfing tee 49. The fabric is of a predetermined width, whereby the golfing tee 49 will protrude from both the top and bottom openings 45, 47 to facilitate extraction of the tee 49 from the tee loop opening. This feature facilitates extraction of an individual tee by applying upward pressure against the lower point of the enclosed tee which causes the selected tee to move in an upward direction above the level of the other tees stored in adjacent pockets, whereby it can be easily removed for use. This feature, along with the rubber backing, also allows for the accommodation of various sizes of tees and allows rapid selection of the tee of the desired length as dictated by ground condition and the area upon which the tee is to be placed or the club selection for that particular activity or individual preference. Visibility of the tees retained within the holders of the invention further allows the individual utilizing the accessory pocket to monitor the number of tees immediately available and replenish tees as necessary. This feature also precludes an individual from arriving at an area requiring use of tee and finding that he has previously lost or broken the final tee in his immediate possession. Again the backing strip 24 with its horizontal rows of rubber-like material facilitates retention of the tees within the holders since the tees contact the rubber backing during insertion and are engaged by frictional contact when in the position shown in FIG. 1.

As shown in FIG. 2, the accessory pocket 11 of the invention can also include a green repair tool pocket 51, including a green repair tool opening 53 for receiving a green repair tool (55 in FIG. 1). The ball-mark/green repair tool 55 will be familiar to golfing enthusiasts and protrudes sufficiently from the top edge of the loop 51 to facilitate grasping for easy extraction. The loop pocket is constructed in such manner as to facilitate retention of the ball-mark/green repair tool 55 until such time as use of the tool is required. Again, the fabric pocket 51 can have a separate backing strip of rubber-like material to thereby exert frictional retention pressure against the tool until use is required.

As shown in FIG. 1, the accessory pocket 11 also includes at least one ball marker retainer 57 located on the panel planar outer wall portion 19 of the panel 15. The ball marker retainer 57 has a snap fastener recess 59 for retaining a ball marker 61 of the type comprising a disc-like portion 63 having a projecting stud 65 with a headed portion adapted to be received within the snap fastener 59. Preferably, two ball marker retainers 57, 67 are provided at opposite extents of the top edge 21 of the panel 15. The ball mark retainers 57, 67 are permanently affixed to the top left and right corners, respectively, of the score card pocket in such a manner as to not interfere with the insertion of the score card into the pocket. The retainers 57, 67 provide for the snap engagement of two ball markers used as required when engaged in golfing activities.

The accessory pocket 11 can also include a mating hook and loop fabric surface (69 in FIG. 2) covering a portion of the panel planar outer wall 19 for engaging a mating hook and loop fabric of a golfing glove (71 in FIG. 1) to temporarily secure the golfing glove to the accessory pocket. The mating hook and loop surface 69 is preferably a VELCRO hook segment approximately 1½ inches by 1½ inches attached to the panel outer wall 19 in such manner as to not interfere with the utilization and function of the adjacent accessory loop pockets. The surface 69 can be utilized for the long term attachment and storage of a golfing glove before or after engaging in golfing activities or for temporary attachment during engagement in specific golfing activities, such as putting, which are frequently performed without the use of the golf glove.

Figure 4:
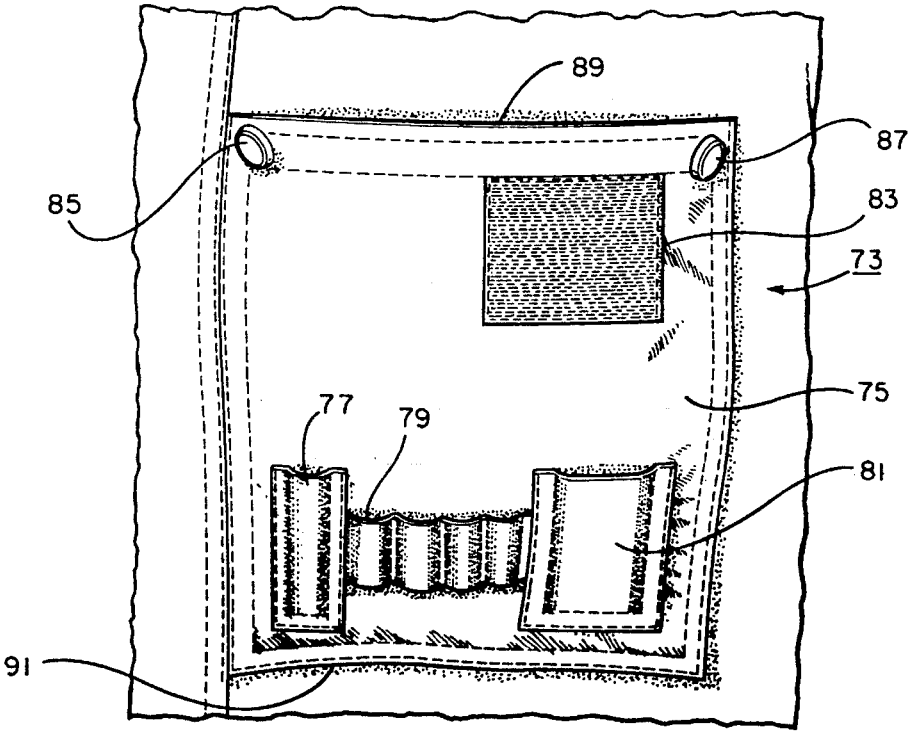
FIG. 4 is an isolated view of another embodiment of the accessory pocket of FIG. 1 in which the panel top edge is generally horizontal, rather than being formed at an angle as in FIG. 2.

FIG. 4 shows another embodiment of the accessory pocket of the invention designated as 73. In this case, the accessory pocket 73 again includes a panel 75 with the same pencil pocket 77, tee loop openings 79, green repair tool loop 81, VELCRO fabric surface 83 and ball markers 85, 87. In this case, however, the panel top edge 89 runs in a horizontal plane which is generally parallel to the bottom edge 91. In all other respects, the configuration and function of the accessory pocket 73 are identical to the pocket 11 shown in FIG. 2.

Figure 5:
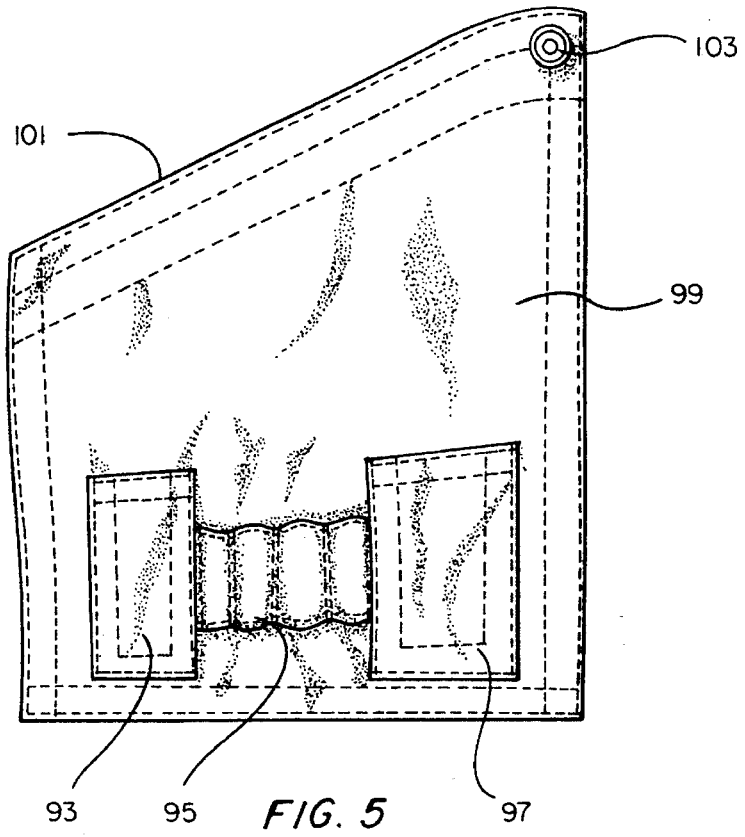
FIG. 5 is an isolated view of another embodiment of the accessory pocket of the invention in which the mating hook and loop attachment is not present.

FIG. 5 also shows another version of the accessory pocket having a pencil pocket 93, tee loop openings 95, green repair tool loop 97. In the embodiment of FIG. 5, there is no mating hook and loop fabric surface on the fabric panel 99, however. The pocket opening 101 is cut at an angle and terminates in a single ball marker 103 at the upper extent thereof.

An invention has been provided with several advantages. The accessory pocket of the invention is of low profile and closely conforms to the wearer's body to provide minimum interference and inconvenience during normal golfing activities. The accessory pocket is permanently affixed to the item of wearing apparel serving as a constant reminder to the golfer to replenish the needed accessory items, such as golfing tees. The accessory pocket is simple in design, economical to manufacture in large quantities, aesthetically pleasing in appearance, and can be affixed to the item of wearing apparel during the time of manufacture of the item or during post-manufacturing operations. The accessory pocket provides complimentary receptacles for holding each of the most commonly employed golfing accessories. By selecting a complimentary fabric and color for the panel and fabric loops an accessory pocket can be provided which is complimentary to the item of wearing apparel. Because the accessory pocket is of low profile and does not attach to the wearer's belt or waist area, the greatest freedom of movement is afforded to the wearer. The special backing strip used for the engaging loop openings enhances the frictional engagement of the accessories within the loops while allowing an outer fabric strip properly color coordinated with the fabric of the remaining panel to be utilized.

While the invention has been shown in only two of its forms, it is not thus limited but is susceptible to various changes and modifications without departing from the spirit thereof.

What is claimed is:

1. An accessory pocket for an item of golfing wearing apparel, comprising:

a low profile panel made of a soft material adapted to conform to a wearer's body, the panel having a planar inner wall, a planar outer wall, a top edge, a bottom edge and opposing side edges, at least selected edges of the panel being adapted to be permanently affixed to the item of wearing apparel to define a pocket having a pocket opening selectively sized to receive a golfing scorecard;

a fabric strip running generally horizontally across the outer planar wall between the opposing side edges, the fabric strip being attached to the panel at selected intervals to form a series of discrete vertical tee loop openings for receiving golfing tees, each tee loop opening including a top opening and a bottom opening for exposing a top and bottom portion, respectively, of a golfing tee, the stretch fabric being of a predetermined width whereby a golfing tee will protrude from both the top and bottom openings of a selected tee loop opening to facilitate extraction of the tee from the tee loop opening; and a separate backing strip for the fabric strip which forms the loop openings, the separate backing strip having an interior surface at least partly covered by a rubber-like material, the rubber-like material being arranged as at least one horizontal row which is attached to the interior surface of the backing strip which runs generally horizontally across the outer planar wall between the opposing edges.

2. An accessory pocket for an item of golfing wearing apparel, comprising:

a low profile panel made of a soft material adapted to conform to a wearer's body, the panel having a planar inner wall, a planar outer wall, a top edge, a bottom edge and opposing side edges, at least selected edges of the panel being adapted to be permanently affixed to the item of wearing apparel to define a pocket having a pocket opening selectively sized to receive a golfing scorecard;

a fabric strip running generally horizontally across the outer planar wall between the opposing side edges, the fabric strip being attached to the panel at selected intervals to form a series of discrete vertical tee loop openings for receiving golfing tees, each tee loop opening including a top opening and a bottom opening for exposing a top and bottom portion, respectively, of a golfing tee, the fabric strip being of a predetermined width whereby a golfing tee will protrude from both the top and bottom openings of a selected tee loop opening to facilitate extraction of the tee from the tee loop opening;

a fabric pencil pocket for receiving a golf scoring pencil;

a fabric green repair tool pocket for receiving a green repair tool;

a separate backing strip for the fabric strip which forms the loop openings, the separate backing strip having an interior surface at least partly covered by a rubber-like material, the rubber-like material being arranged as at least two horizontally spaced-apart rows which are attached to the interior surface of the backing strip and which run generally horizontally across the outer planar wall between the opposing side edges; and at least one ball marker retainer located on the panel planar outer wall having a snap fastener recess for retaining a ball marker of the type comprising a disc-like portion having a projecting stud with a headed portion adapted to be received within the snap fastener recess.

3. The accessory pocket of claim 2, wherein the bottom edge and opposing side edges are affixed to the item of wearing apparel to define a top pocket opening for the accessory pocket for receiving a golfing scorecard and wherein the panel top edge is cut at an angle with respect to the panel bottom edge to leave at least a portion of a golfing scorecard visible when inserted into the accessory pocket.

4. The accessory pocket of claim 3, wherein the panel is formed of a cloth material which is complimentary to the fabric and color of the item of wearing apparel and wherein the fabric strip used to form the vertical loop openings is complimentary to the fabric and color of the remainder of the panel.

5. The accessory pocket of claim 3, wherein the panel is permanently affixed to the item of wearing apparel at the time of manufacture of the item.

6. The accessory pocket of claim 3, wherein the panel is permanently affixed to the item of wearing apparel in a post-manufacturing operation.

* * * * *